United States Patent [19]

Hunter

[11] Patent Number: 4,836,449

[45] Date of Patent: Jun. 6, 1989

[54] SPRINKLER UNIT WITH STREAM DEFLECTOR

[76] Inventor: Edwin J. Hunter, 5551 Codorniz Rd., Rancho Santa Fe, Calif. 92067

[21] Appl. No.: 187,964

[22] Filed: Apr. 29, 1988

Related U.S. Application Data

[63] Continuation-in-part of Ser. No. 49,843, May 15, 1987, Pat. No. 4,796,809.

[51] Int. Cl.[4] ..... B05B 3/04

[52] U.S. Cl. ..... 239/232; 239/507; 239/511; 239/521

[58] Field of Search ..... 239/232, 236, 505, 507, 239/511, 509, 510, 513, 516, 518, 521

[56] References Cited

U.S. PATENT DOCUMENTS

| | | | |
|---|---|---|---|
| 1,938,838 | 12/1933 | Jacobson | 239/236 |
| 3,960,327 | 6/1976 | Olson | 239/236 |
| 4,198,000 | 4/1980 | Hunter | 239/232 |
| 4,198,001 | 4/1980 | Rodriguez | 239/236 |
| 4,538,762 | 9/1985 | Lemkin | 239/232 |
| 4,624,412 | 11/1986 | Hunter | 239/232 |
| 4,637,549 | 1/1987 | Schwartzman | 239/236 |
| 4,648,558 | 3/1987 | Rabitsch | 239/232 |

*Primary Examiner*—Andres Kashnikow
*Assistant Examiner*—Christopher G. Trainor
*Attorney, Agent, or Firm*—Baker, Maxham, Jester & Meador

[57] ABSTRACT

A sprinkler unit having a continuously rotating nozzle includes a stream interruptor comprising a pin mounted on a carriage pivotally mounted on the nozzle and a cam surrounding the nozzle that has a series of cam surfaces for intermittently caming the carriage assembly and the interrupting pin into the stream to periodically interrupt the stream as the nozzle rotates about its axis to cause a more even distribution of water over the surface area surrounding the sprinkler unit.

20 Claims, 2 Drawing Sheets

FIG. 1
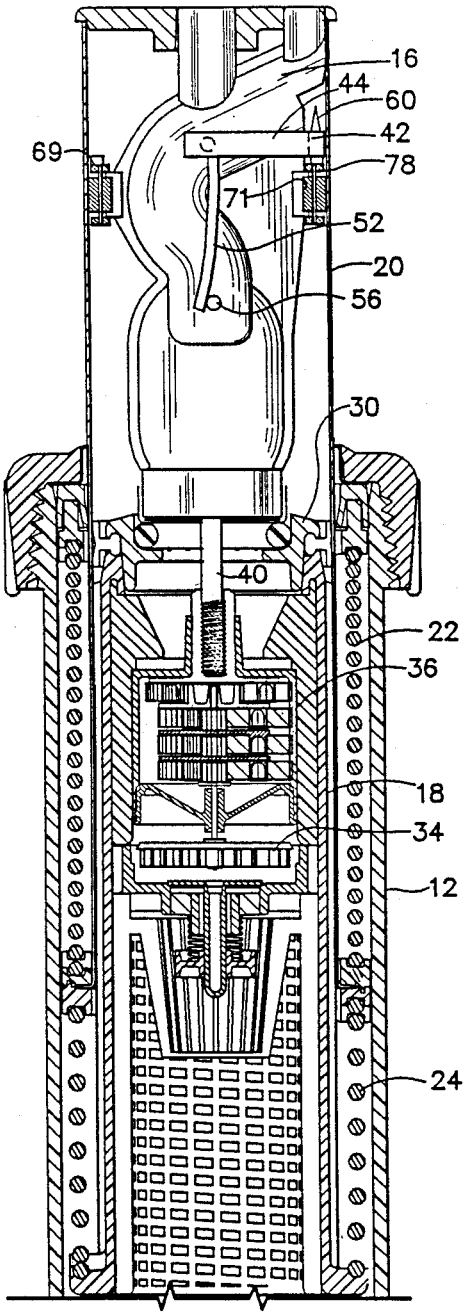
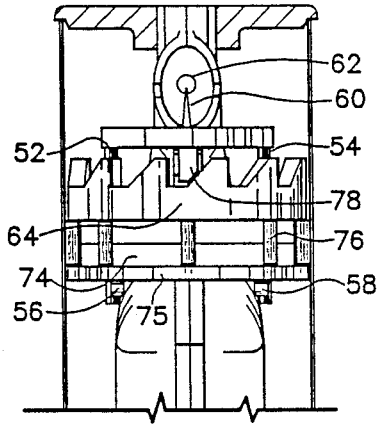
FIG. 2
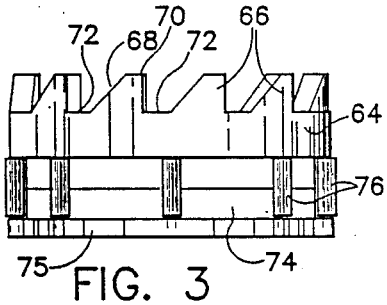
FIG. 3

SPRINKLER UNIT WITH STREAM DEFLECTOR

REFERENCE TO RELATED APPLICATION

The present application is a continuation-in-part of my co-pending application Ser. No. 049,843, filed May 15, 1987, now U.S. Pat. No. 4,796,809, and entitled "TWO-STAGE POP-UP SPRINKLER".

BACKGROUND OF THE INVENTION

The present invention relates to sprinkler units and pertains particularly to units having a stream interruptor for enhancing the distribution of the water stream.

The artificial distribution of water through irrigation systems is in wide use throughout the world today. There are many irrigation systems utilized, with each having its benefits and drawbacks.

One of the most widely used systems, particularly where water is valuable, is the sprinkler unit wherein a plurality of nozzles are distributed about an area for distributing water over the surface of the land area. Such systems are widely used for lawns, golf courses, playing fields and many field crops.

The ideal sprinkler irrigation system would achieve a uniform distribution of water over a maximum area with a minimum number of nozzles. This approach presents a major problem since the optimum reach of a sprinkler unit is inconsistent with optimum distribution. Optimum reach of a sprinkler unit is achieved by maintaining a coherent or homogenous water stream. For a rotating stream sprinkler unit having a coherent stream, the majority of the water would be distributed in a circular path at the outermost reach of the stream forming a circle surrounding the sprinkler unit. In order to cover the area inside the circle toward the center of axis of rotation, it is necessary to interrupt the stream to cause deflection of a portion of the stream over the inner area. Many attempts have been made in the past to provide an optimum mechanism for achieving a proper distribution of water over the area. While many of these attempts have proven to be somewhat effective, they have not been entirely satisfactory.

Accordingly, it is desirable that an optimum mechanism be available for interrupting a stream of water from a sprinkler unit to provide optimum water coverage.

SUMMARY AND OBJECTS OF THE INVENTION

Accordingly, it is a primary object of the present invention to provide a sprinkler unit having means for achieving an optimum uniform coverage.

In accordance with the primary aspect of the present invention, a sprinkler unit comprises a continuously rotating nozzle, with interrupting means carried by the nozzle, and having biasing means for intermittently biasing the interrupting . means into the nozzle stream for intermittently interrupting the stream issuing therefrom.

BRIEF DESCRIPTION OF THE DRAWING

The above and other objects and advantages of the present invention will become apparent from the following description when read in conjunction with the drawings wherein:

FIG. 1 is a side elevation view partially in section of a typical sprinkler unit showing a preferred embodiment of the invention;

FIG. 2 is a front elevation view partially in section of the interruptor assembly and nozzle of FIG. 1;

FIG. 3 is an enlarged side elevation view of the cam and race assembly;

DETAILED DESCRIPTION OF A PREFERRED EMBODIMENT

Figure 4:
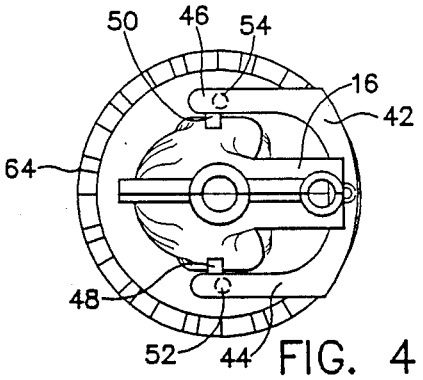
FIG. 4 is a top view of the nozzle showing the interruptor and the cam.

Referring now to the drawings, particularly FIG. 1, there is illustrated a sprinkler unit of the continuous rotary type embodying a preferred embodiment of the present invention. The sprinkler unit, in accordance with the invention, is designated generally by the numeral 10 and comprises a cylindrical body 12 having an inlet end 14 with means (not shown) for threadable attachment to a source of pressurized water, and an outlet end from which a nozzle 16 projects for distributing water.

An inner housing 18 and a tubular sleeve 20 are reciprocably mounted within the housing, and include radial flanges at the lower end thereof engaged by return springs 22 and 24 biased against the radial flanges, and an upper retainer ring and retainer cap of the housing 12 to bias the housing and sleeve in or to the retracted position. The illustrated sprinkler unit is a pop-up type having a continuously rotatable nozzle 16. A turbine and reduction drive assembly is mounted in .the second inner housing for driving the nozzle. The inner housing 18 is mounted within the outer housing and extends into the protective sleeve 20 for reciprocable movement therewith for protective extension and retraction through a layer of soil.

The tubular sleeve 20 has a lower or radial flange at the lower end against which a coil compression spring 22 biases at the lower end, and engages a flange of a removable retaining cap 26 of the outer housing at the upper end. The inner housing 18 is mounted within the outer housing, with the outer sleeve 20 being disposed between the inner and outer housings and retractable into the outer housing 12.

The sprinkler unit is designed to first extend the inner housing 18 and the sleeve 20 together through and to a position above the ground surface, and then extend the inner housing with the nozzle unit 16 therein, such that the nozzle projects from the outer or upper end of sleeve 20 and is exposed for distribution of water.

The inner housing includes mounting ring 30 at the upper end on which is rotatably mounted the nozzle 16, which is also supported at its upper end by a roller bearing assembly, including an annular raceway 74 with roller bearings 76 for rolling on and slideably engaging the inner wall of the sleeve 20. The sleeve 20 acts as the outer raceway for the rollers 76.

The nozzle is rotatably driven by a turbine 34 within the inner housing (FIG. 1), which drives through a multiple reduction gear drive unit 36 and a drive shaft 40 for driving the sprinkler unit or nozzle 16. When the sprinkler unit is pressurized with a source of water, the sprinkler unit pops up or extends up above the surface of the ground with the sprinkler or nozzle exposed, and the turbine 34 responds to the flow of water therethrough for driving the nozzle for rotation thereof around a vertical axis in a three-hundred sixty degree circle. Continuous rotation of the nozzle 16 distributes a stream of water in a circular path around the axis thereof.

The nozzle 16 is designed to form a coherent stream of water to issue therefrom and achieve the maximum reach at a given water pressure and flow. The curve of the nozzle forming a transmission from the axial direction outward is on one side of the axis, leaving the full radius of the bore of sleeve 20 for a straight section of the nozzle up so its outlet to form a coherent stream. An orifice insert detachably mounts in the outlet end of the nozzle to form and size the final stream.

A stream interruptor assembly (FIGS. 1, 2 and 4) is mounted on the nozzle unit and comprises a generally U-shaped yoke or support member 42 having a pair of arms 44 and 46 that extend to each side of the nozzle, with pivot pins 48 and 50 extending into bores (not shown) on the side of the nozzle. A pair of elongated elastic arms or fingers 52 and 54 extend downward from the yoke arms at the juncture of the pivot pins for engaging pins 56 and 58 FIG. 2) on the side of the nozzle 16, and act as springs for biasing the yoke member and interruptor to the retracted position.

A pin or finger 60, having a somewhat conical configuration, is mounted in the connector arm or portion of the yoke 42, and is positioned to be biased upward into the stream issuing from the nozzle orifice 62. The fingers 52 and 54 bias the yoke to its normal position, with the interruptor pin 60 to a retracted position out of the flow stream. A cam assembly comprising a ring member 64, having a plurality of axially extending cam members 66 disposed around the circumference thereof, is mounted within the sleeve 20 and carried by a rotor or roller bearing assembly for rotation at a different rate from that of the nozzle. The cam 64 comprises a ring having a saw tooth configuration of cam members 66, each having a ramp 68 up to a flat 70 with a space including a flat 72 between adjacent cams.

Figure 5:
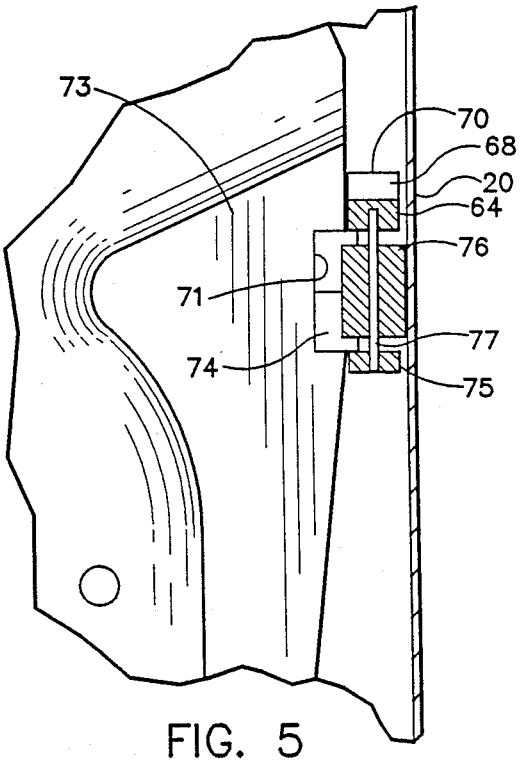
FIG. 5 is an enlarged detail view of the roller assembly.

The cam ring 64 is carried by a roller bearing assembly which includes a raceway 74 mounted on and encircling the nozzle (FIGS. 2 and 5), and on which roller bearings 76 are mounted for rolling engagement therewith, and with sleeve 20 for support of the nozzle within sleeve 20 for its rotation. The raceway 74 mounts in notches 69 and 70 at the back and front respectively of the nozzle body 16 (FIG. 1). The notch 71 is formed in a forwardly extending web 73 (FIG. 1) of the nozzle body. The rollers 76 roll on the surfaces of the raceway 74, and the inner surface of sleeve 20 acting much like a planetary gear train carrying cam ring 64, and the roller carrier or cage around in the same direction as the nozzle at a slower speed. The raceway 74 is equivalent to a sun gear, the rollers 76 are equivalent to planetary gears and the sleeve 20 equivalent to a ring gear. The roller cage or carrier comprises cam ring 64 and a ring 75 between which are mounted rollers 76 on pins or shafts 77.

The cam member 64 is carried by the roller assembly at a rotary velocity of less than that of the nozzle because it is carried by rollers 76. As the nozzle 16 rotates, it carries the interruptor pin 60 and yoke 42 assembly with it, and the cam follower or pin 78 rides up on the successive cams 66 on the cam ring 64. The follower 78 rides up the cam, biasing the yoke upward, carrying the interrupting pin 60 into the stream of water, interrupting the stream until the follower rides up surface 68, and across the top 70 of the cam to drop down the opposite side in the flat 72 between cams, and enables the spring assembly to retract the stream interrupting pin.

The continued rotation of the nozzle carries the flow interrupting assembly, with the follower into engagement with the next successive cam, where it rides up the cam, biasing the interrupting pin into the flow stream, again interrupting the stream until it rides over that cam, and is again retracted. Successive operation in this manner results in intermittent staggered interruption of the flow stream, such that the flow alternately extends to its full throw and is interrupted to cover or break up the stream for coverage of the area between the axis of rotation and the outermost reach thereof. This periodic interruption is staggered around the circumference of the circle, resulting in an almost completely uniform coverage of the circular area surrounding or covered by the nozzle.

The shape of the pin can effect the degree and character of the interruption of the flow stream. Illustrated herein is a first pin 60 of a generally conical configuration, having a generally smooth, uniform outer surface.

Figure 6:
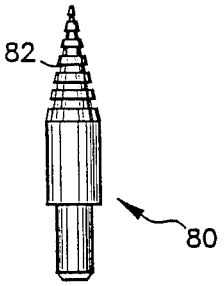
FIG. 6 is a side elevation view of an alternate interruptor pin.

Referring to FIG. 6, an alternate embodiment of the interruptor finger is illustrated wherein a generally conical shape pin 80 is provided, with a series of rings 82 or grooves around the surface thereof. This surface effect (i.e. grooves) increases the degree of interruption of the flow stream, thus enhancing the distribution between the axis of rotation and the outer reach thereof.

Changes in shapes and sizes of the pin and in the cam affect the degree and extent of interruption of the stream and the consequent distribution as a result thereof. The cam can be altered to alter the duration of rotation during which interruption of the stream takes place. The degree of interruption can also be altered by altering the surfaces of the cams and spacing therebetween.

While I have illustrated and described my invention by means of preferred embodiments, it is to be understood that numerous changes and modifications may be made therein without departing from the spirit and scope of the invention as defined in the appended claims.

I claim:

1. An interrupted stream rotary sprinkler unit comprising:

a housing having an inlet and an outlet and means for connecting said inlet to a source of water;

a nozzle rotatably mounted at said outlet for distributing a stream of water about said housing;

means in said housing for rotating said nozzle; and stream interrupting means mounted for rotation with said nozzle and comprising first means periodically biased into and interrupting said stream and second means rotatable about a common axis with said nozzle for periodically biasing said first means wherein said second means for periodically biasing comprises a ring mounted for rotation about said nozzle.

2. An interrupted stream rotary sprinkler unit according to claim 1 wherein:

said first means comprises a finger pivotally mounted on said nozzle for rotation therewith; and said second means for periodically biasing said finger into said stream further comprises a multiple lobe cam.

3. An interrupted stream rotary sprinkler unit according to claim 1 wherein:

said second means for periodically biasing further comprises a cam.

4. An interrupted stream rotary sprinkler unit according to claim 2 wherein:

said multiple lobe cam includes a plurality of cam members on said ring.

5. An interrupted stream rotary sprinkler unit according to claim 1 wherein:

said first means comprises a generally C-shaped frame member pivotally engaging opposite sides of said nozzle; and a pin mounted on said frame and positioned below said stream;

and wherein said second means further includes a plurality of cam members for periodically engaging said frame for biasing said pin into said stream.

6. An interrupted stream rotary sprinkler unit according to claim 5 wherein:

said cam ring rotates at a rate different to that of the nozzle.

7. An interrupted stream rotary sprinkler unit according to claim 5 wherein:

said pin is tapered to a point that extends into said stream.

8. An interrupted stream rotary sprinkler unit according to claim 5 wherein:

said frame member includes spring means extending downward therefrom for biasing said pin away from said stream.

9. An interrupted stream rotary sprinkler unit according to claim 5 wherein:

said cam members are spaced apart around said ring and each includes a dwell portion that is slightly less than the spacing between said members.

10. An interrupted stream rotary sprinkler unit comprising:

a housing having an inlet and an outlet and means for connecting said inlet to a source of water;

a nozzle rotatably mounted at said outlet for distributing a stream of water about said housing;

means in said housing for rotating said nozzle; and stream interrupting means comprising a finger pivotally mounted on said nozzle for rotation therewith and cam means mounted for rotation about a common axis with said nozzle for periodically biasing said finger into said stream for periodically interrupting said stream from said nozzle wherein said cam means includes a ring mounted for rotation about said nozzle.

11. An interrupted stream rotary sprinkler unit according to claim 10 wherein:

said cam means comprises a planetary roller assembly and further including a plurality of cam members on said ring.

12. An interrupted stream rotary sprinkler unit according to claim 10 wherein:

said stream interrupting means further comprises a generally C-shaped frame member pivotally engaging opposite sides of said nozzle;

and wherein said ring includes a plurality of cam members for periodically engaging said frame for biasing said finger into said stream.

13. An interrupted stream rotary sprinkler unit according to claim 12 wherein:

said cam ring rotates at a rate different to that of the nozzle.

14. An interrupted stream rotary sprinkler unit according to claim 13 wherein:

said finger is tapered to a point that extends into said stream.

15. An interrupted stream rotary sprinkler unit according to claim 14 wherein:

said finger member includes spring means extending downward therefrom for biasing said finger away from said stream.

16. An interrupted stream rotary sprinkler unit according to claim 15 wherein:

said cam members are spaced apart around said ring and each includes a dwell portion that is slightly less than the spacing between said members.

17. An intermittently interrupted stream rotary sprinkler unit comprising:

a housing having an inlet and an outlet and means for connecting said inlet to a source of water;

a nozzle rotatably mounted for rotation about a vertical axis at said outlet for distributing a stream of water outwardly about said housing;

means in said housing for rotating said nozzle; and stream interrupting means comprising a generally C-shaped frame member pivotally mounted to opposite sides of said nozzle, a pin mounted on said frame for rotation therewith, said frame member having spring means extending downward therefrom for biasing said pin away from said stream, and a cam ring mounted for rotation about said nozzle and having a plurality of cam members for periodically engaging said frame for periodically biasing said pin into said stream for periodically interrupting said stream from said nozzle.

18. An interrupted stream rotary sprinkler unit according to claim 17 wherein:

said cam ring is carried by a planetary roller assembly and rotates at a rate different to that of the nozzle.

19. An interrupted stream rotary sprinkler unit according to claim 18 wherein:

said cam members are spaced apart around said ring and each includes a dwell portion that is slightly less than the spacing between said members.

20. An intermittently interrupted stream rotary sprinkler unit comprising:

a housing having an inlet and an outlet and means for connecting said inlet end to a source of water;

a nozzle rotatably mounted for rotation about a vertical axis at said outlet for distributing a stream of water outwardly about said housing;

means in said housing for rotating said nozzle;

stream interrupting means comprising a generally C-shaped frame member pivotally mounted to opposite sides of said nozzle, a pin mounted on said frame for rotation therewith, said frame member having spring means extending downward therefrom for biasing said pin away from said stream, and a cam ring carried by a planetary roller assembly mounted for rotation about said nozzle at a rate different from that of said nozzle and having a plurality of cam members for periodically engaging said frame for periodically biasing said pin into said stream for periodically interrupting said stream from said nozzle; and said planetary roller assembly comprises a raceway mounted on and surrounding said nozzle, a plurality of rollers positioned around said raceway, a carrier comprising said cam ring and a support ring spaced therefrom for mounting said rollers therebetween, and an elongated tubular sleeve surrounding said nozzle and defining an outer ring member for rolling engagement and support of said rollers.

* * * * *